US008430278B2

(12) United States Patent
Broderick

(10) Patent No.: US 8,430,278 B2
(45) Date of Patent: Apr. 30, 2013

(54) FLOATING FLUID INLET FOR LIQUID CONTAINERS AND METHOD OF USE THEREOF

(76) Inventor: William Broderick, Newnan, GA (US)

( * ) Notice: Subject to any disclaimer, the term of this patent is extended or adjusted under 35 U.S.C. 154(b) by 285 days.

(21) Appl. No.: 13/011,331

(22) Filed: Jan. 21, 2011

(65) Prior Publication Data

US 2012/0187156 A1 Jul. 26, 2012

(51) Int. Cl.
*B67D 7/78* (2010.01)

(52) U.S. Cl.
USPC ..... 222/464.6

(58) Field of Classification Search .... 222/464.1–464.7, 222/382; 137/434, 438, 442, 443, 544, 547, 137/549
See application file for complete search history.

(56) References Cited

U.S. PATENT DOCUMENTS

| | | | | |
|---|---|---|---|---|
| 558,131 | A | 4/1896 | Warren | |
| 836,335 | A * | 11/1906 | Nichols et al. | 210/242.1 |
| 1,528,003 | A | 3/1925 | Yarnall | |
| 2,010,363 | A * | 8/1935 | Hine | 137/556 |
| 2,986,310 | A | 5/1961 | Spaulding | |
| 3,172,581 | A * | 3/1965 | Nanni | 222/464.6 |
| 3,381,709 | A | 5/1968 | Pregno | |
| 3,631,880 | A * | 1/1972 | Hansel | 137/172 |
| 4,940,152 | A | 7/1990 | Lin | |
| 5,657,909 | A | 8/1997 | Barriac | |
| 6,287,460 | B1 * | 9/2001 | Van Schie | 210/122 |
| 6,915,818 | B2 * | 7/2005 | Burris et al. | 137/544 |
| 7,331,489 | B2 | 2/2008 | Glynn et al. | |
| 2010/0163117 | A1 | 7/2010 | James | |

* cited by examiner

*Primary Examiner* — Paul R Durand
*Assistant Examiner* — Matthew Lembo
(74) *Attorney, Agent, or Firm* — Matthew L. Grell; Balser & Grell IP Law

(57) ABSTRACT

A floating fluid inlet that adjusts to the level of a beverage within a soda keg or similar container. The floating fluid inlet is constructed preferably of stainless steel and food grade plastic tubing. By rotating its inlet port aperture from downward facing when the soda keg is full of a beverage, to upward facing when the soda keg is nearly empty, the floating fluid inlet avoids picking up sediment from the bottom of the soda keg. The principal components are a tube that connects at its one end to the outlet port of a soda keg and at its other end to a pickup tube that is retained within a bracket to which is attached a float. The pickup tube has an aperture disposed in its sidewall for ingress of a beverage.

17 Claims, 3 Drawing Sheets

FIG. 1 - PRIOR ART

FLOATING FLUID INLET FOR LIQUID CONTAINERS AND METHOD OF USE THEREOF

CROSS-REFERENCE TO RELATED APPLICATIONS

None

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field of the Invention

The present invention relates generally to floating intake ports for extracting liquid from containers, and more specifically to a floating inlet tube with an opening that avoids extracting sediment from the bottom of the container.

2. Description of Related Art

When extracting a liquid from a container, it is typical to provide a pickup tube that remains below the surface of the liquid so that air or other gas above the liquid surface does not enter the liquid that is being extracted.

One previous device addresses this problem by teaching a nursing bottle having a nipple, a bottle portion, and a flexible dip tube adapted with a float near the drawing aperture thereof. The drawing aperture of the dip tube is thus always maintained slightly below the liquid surface so that liquid is always drawn from around the surface of the liquid. While the bottle is full, the aperture points upward (but below the liquid surface); however, when the bottle has very little liquid left in it, it does not support the float and the drawing aperture is positioned downward because of attached weighting means, thereby becoming more likely to pick up any sediments that exist on the bottom of the bottle.

When brewing a yeast-containing beverage, such as beers and ales, it is common to produce sediments that typically eventually settle on the bottom of a container in which the beverage is stored for use. While the sediments are often strained/filtered, smaller particles often remain and are consumed either from the storage bottle itself, or if obtained from a bulk container, fed into a consumer's glass. Accordingly, it is desirable to minimize the amount of sediments passed into a beverage drinker's glass from the storage container.

Many beverages are commonly stored in soda kegs, which are vessels that are pressurized to transfer the beverage through a pickup tube and/or to carbonate the beverage. However, because soda kegs are typically utilized for non-yeast-containing beverages, the pickup tube is fixed with its opening near the bottom of the soda keg since there are no concerns about sediments being extracted with the beverage.

Therefore, it is readily apparent that in order to utilize a soda keg for containment of a yeast-containing beverage, there is a need for a pickup tube with an aperture directed away from any sediment when the pickup tube is near the bottom of the container.

BRIEF SUMMARY OF THE INVENTION

Briefly described, in a preferred embodiment, the present invention overcomes the above-mentioned disadvantages and meets the recognized need for such an apparatus by providing a floating fluid inlet that adjusts to the level of a beverage within a soda keg or similar container. The floating fluid inlet is constructed preferably of stainless steel and food grade plastic tubing, such as, for exemplary purposes only, silicone tubing. By rotating its inlet port aperture from a downward facing disposition when the soda keg is full of a beverage, to an upward facing disposition when the soda keg is nearly empty, the floating fluid inlet avoids picking up sediment from the bottom of the soda keg.

According to its major aspects and broadly stated, the present invention in its preferred form is a floating fluid inlet comprising a float and a pickup tube having a first end and second end. The pickup tube has a first portion including the first end and a second portion including a long axis, the second end and a sidewall. The sidewall has an aperture therein providing access to the center of the pickup tube.

A bracket secures the pickup tube to the float, wherein the bracket has openings dimensioned to receive the pickup tube and to permit rotation of the pickup tube about its long axis within the openings. The bracket further has two legs, a first leg and a second leg, with an opening being disposed in each of the two legs. The two legs are substantially parallel. The float is secured to the bracket via a removable cooperative fastener.

The floating fluid inlet further comprises a retainer and a retaining plug, wherein the retainer is removably disposed on the pickup tube outboard of the first leg from the aperture, and wherein the retaining plug is removably disposed on the pickup tube outboard of the second leg from the aperture, thereby sealing the second end of the pickup tube.

The floating fluid inlet further comprises a flexible tube having a first extremity and a second extremity, wherein the first extremity is removably secured to an outlet port extension of a soda keg, and wherein the second extremity is removably secured to the first end of the pickup tube.

The pickup tube is bent forming a ninety degree angle between the first portion and the second portion, wherein the ninety degree angle results in the first portion being disposed on the same side of the pickup tube as the aperture, and wherein the first portion extends away from a side of the second portion in a first direction, and wherein the aperture is disposed on the same side, and wherein the aperture faces in the same first direction.

The floating fluid inlet is part of a fluid dispensing system comprising a soda keg and the floating fluid inlet, wherein when the floating fluid inlet is disposed at the top of the soda keg by floating upon a beverage surface near the top of the soda keg, the aperture, which is preferably oval shaped, points downward, and wherein when the floating fluid inlet is disposed at the bottom of the soda keg, due to withdrawal of beverage and consequent lowering of the beverage surface to near the bottom of the soda keg, the aperture points upward; the aperture thereby rotating from a downward disposition to an upward disposition as the liquid is drawn from the vessel.

The present invention further comprise a method of drawing liquid from a container, wherein the method comprises obtaining a floating fluid inlet having a float and a pickup tube having a first end, a second end, a sidewall and an aperture in the sidewall; securing a bracket to the float, wherein the bracket has openings dimensioned to receive the pickup tube and permit the pickup tube to rotate about its long axis; securing the pickup tube to the bracket; installing the floating fluid inlet in the container; filling the container with a beverage; and drawing the beverage from the container, wherein the pickup tube rotates from an upwardly disposed position to a downwardly disposed position as the beverage is withdrawn from the container.

Additionally, the method comprises removing the floating fluid inlet from the container, and disassembling the float from the bracket. The floating fluid inlet further comprises a retainer and a retaining plug, and the method further comprises removing the retaining plug and the retainer, thereby facilitating cleaning the float, the pickup tube, the bracket, the retainer and the retaining plug.

The method further comprises reassembling the float to the bracket, reassembling the pickup tube within the bracket, wherein the pickup tube is secured via the retainer and the retaining plug, and reinstalling the floating fluid inlet in the container.

More specifically, the present invention is a floating fluid inlet liquid supply system comprising a soda keg and a floating fluid inlet. The soda keg comprises, for exemplary purposes only, a standard container for dispensing soda beverages at a soda fountain, as is known in the art. The soda keg preferably comprises a bottom, an inlet port, an outlet port, a keg fill port cover and a relief valve, wherein the relief valve is disposed in the keg fill port cover. The outlet port comprises an outlet port extension and the inlet port comprises an inlet port extension. The relief valve could be disposed elsewhere on the soda keg so long as it provides the ability to relieve pressure within soda keg when activated.

The floating fluid inlet comprises a tube, a pickup tube, a retainer, a retaining plug, a bracket and a float. The tube has a first end and a second end. The pickup tube has a first end, a bend, a horizontal section, a second end, a long axis and a sidewall. The sidewall has an aperture therein. The bracket comprises a first leg, a second leg and a flat section, wherein the first leg has a first opening therein, the second leg has a second opening therein and the flat section has a throughhole.

The float preferably comprises a top and a bottom, wherein the bottom has a threaded insert therein. The float is removably secured to bracket via a bolt for disassembly and cleaning/replacement, wherein the bolt passes through the bracket via the throughhole, and wherein bolt subsequently threadedly engages the threaded insert.

The pickup tube may be removed for cleaning and/or replacement and is removably secured to the bracket by passing the second end of the pickup tube through the retainer, wherein the retainer frictionally engages the pickup tube. The second end of the pickup tube is subsequently passed through the first opening and then through the second opening. The pickup tube is secured within bracket via the retaining plug, wherein the retaining plug also seals the second end of the pickup tube. The pickup tube freely rotates about its long axis within the bracket. The first end of the tube is secured to the outlet port extension and the second end of the tube is secured to the first end of the pickup tube, wherein the pickup tube is bent at approximately a ninety degree angle. The first end and the aperture are disposed on the same side of the pickup tube.

In use, a beverage is introduced into the soda keg. The first end of tube is preferably secured to the outlet port extension as described hereinabove. The pickup tube is secured to the second end of the tube and the floating fluid inlet is installed within the soda keg. Subsequently, the soda keg is sealed via the keg fill port cover. The beverage is allowed to stand for a selected period of time to permit sediment to separate from the beverage and accumulate on the bottom of the soda keg. It will be recognized by those skilled in the art that the floating fluid inlet may be introduced into the soda keg after the beverage is allowed to settle without departing from the spirit of the preferred embodiment.

When the soda keg is full, the soda keg is pressurized by a gas via the inlet port and the float carries the floating fluid inlet to the top of the beverage liquid level, wherein the tube hangs downward. With the float at the top of the beverage liquid level and the tube hanging below the float, the pickup tube rotates about its long axis so that the aperture points in a downward fashion, thereby preventing pickup of air from above the beverage. As the beverage is drawn from the soda keg, the float carries floating fluid inlet downward, thereby straightening the tube and causing the pickup tube to rotate about its long axis so that the aperture points upward away from sediment, reducing and/or eliminating sediment pickup.

When the soda keg is empty, pressure is relieved via the relief valve and the system is disassembled for cleaning and refilling.

Accordingly, a feature and advantage of the present invention is its ability to extract liquid from a vessel, drawing from near the top, but below the surface, of the liquid at all times.

Another feature and advantage of the present invention is its ability to avoid picking up sediment from the bottom of the vessel.

Still another feature and advantage of the present invention is its ability to readily disassembled for cleaning.

Yet another feature and advantage of the present invention is its reduced likelihood of becoming plugged by sediment.

Yet still another feature and advantage of the present invention is that it can be utilized with existing soda keg hardware.

These and other features and advantages of the present invention will become more apparent to one skilled in the art from the following description and claims when read in light of the accompanying drawings.

BRIEF DESCRIPTION OF THE SEVERAL VIEWS OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED EMBODIMENT OF THE INVENTION

In describing the preferred embodiment of the present invention, as illustrated in FIGS. 1-5, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
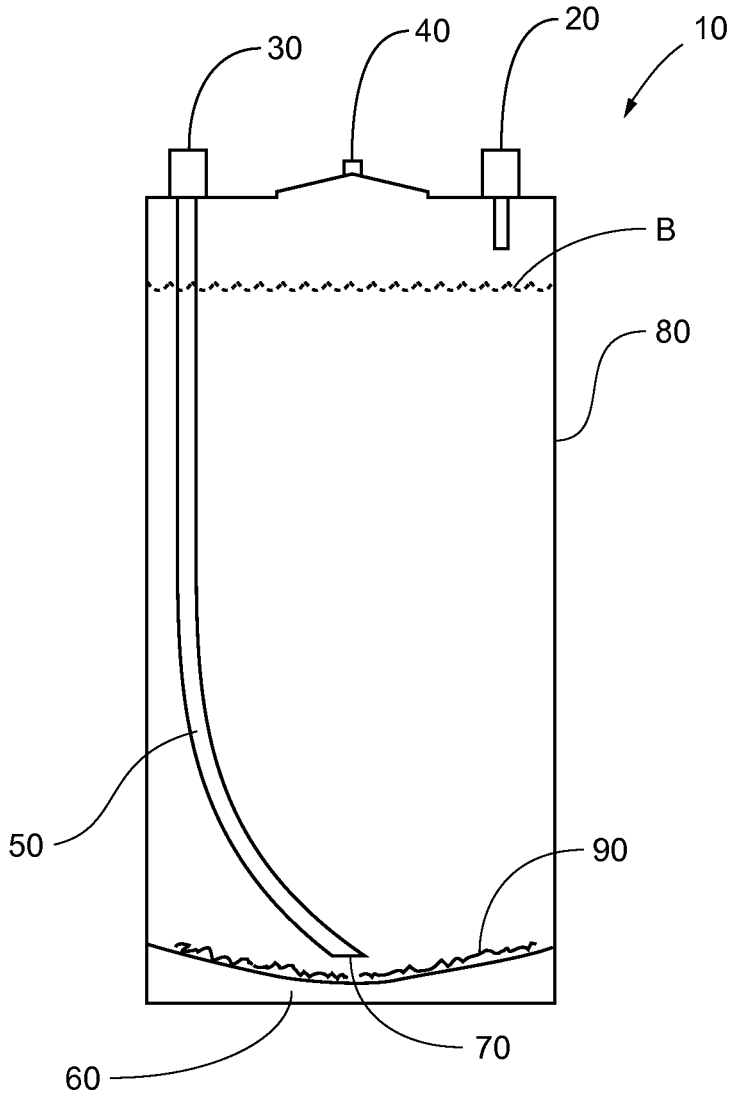
FIG. 1 is a cross-sectional view of a soda keg having a prior art liquid intake tube.
Figure 2:
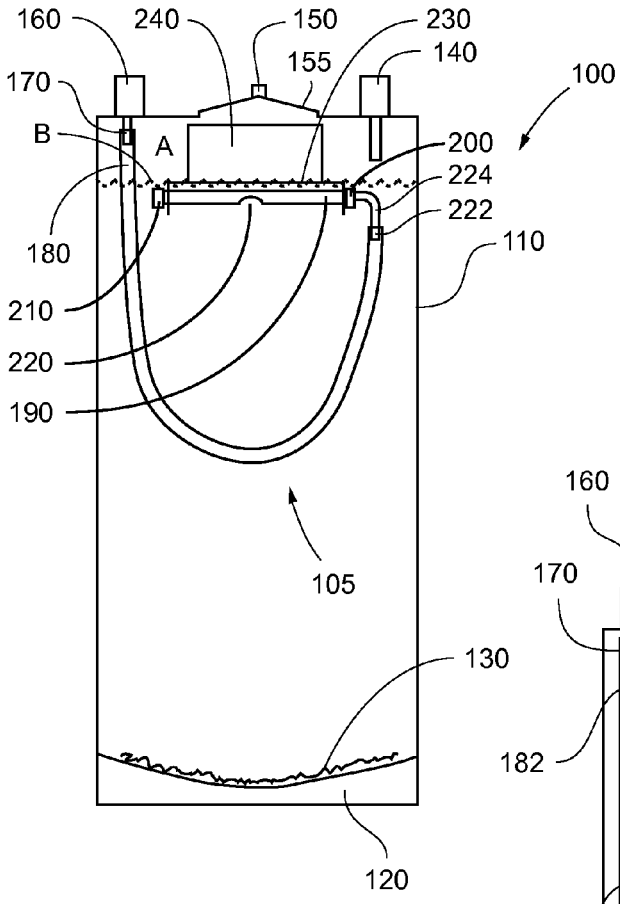
FIG. 2 is a cross-sectional view of a soda keg having a floating fluid inlet according to a preferred embodiment, shown with floating fluid inlet in operation when the soda keg is in near full condition.
Figure 3:
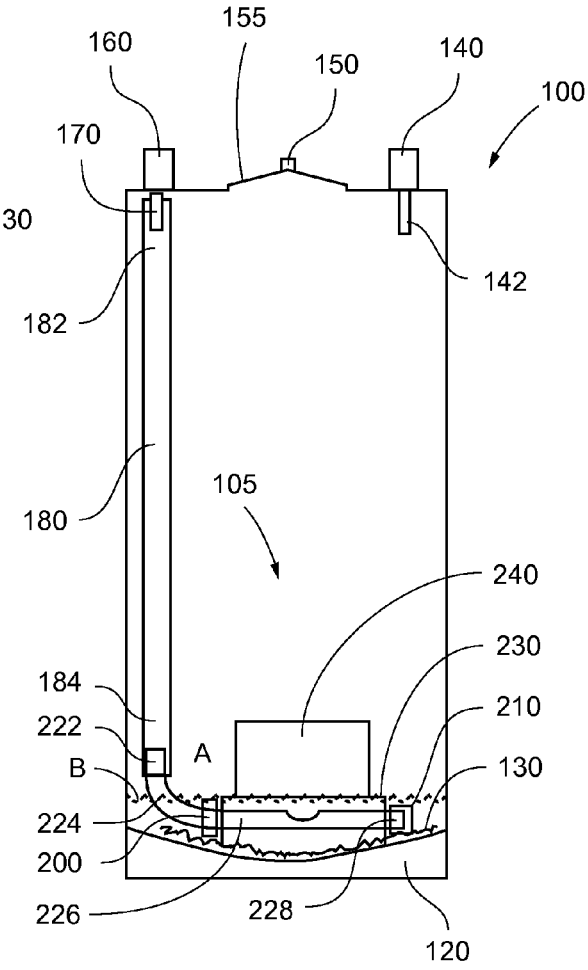
FIG. 3 is a cross-sectional view of a soda keg having a floating fluid inlet according to the preferred embodiment of FIG. 2, shown with floating fluid inlet having rotated to extract liquid without sediment during a near empty condition.
Figure 4:
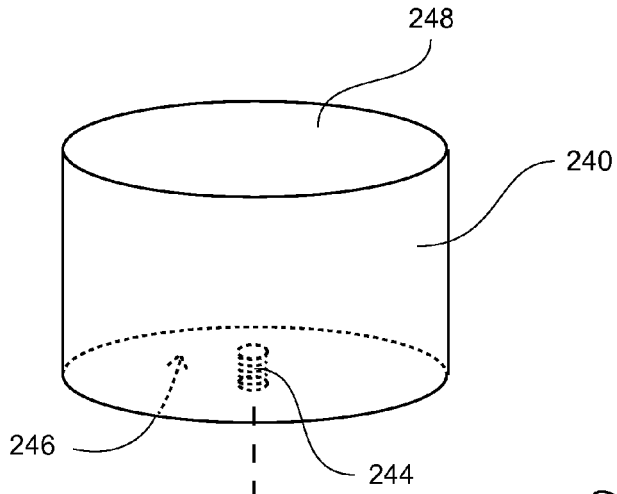
FIG. 4 is a detail view of a float portion of the floating fluid inlet according to the preferred embodiment.
Figure 5:
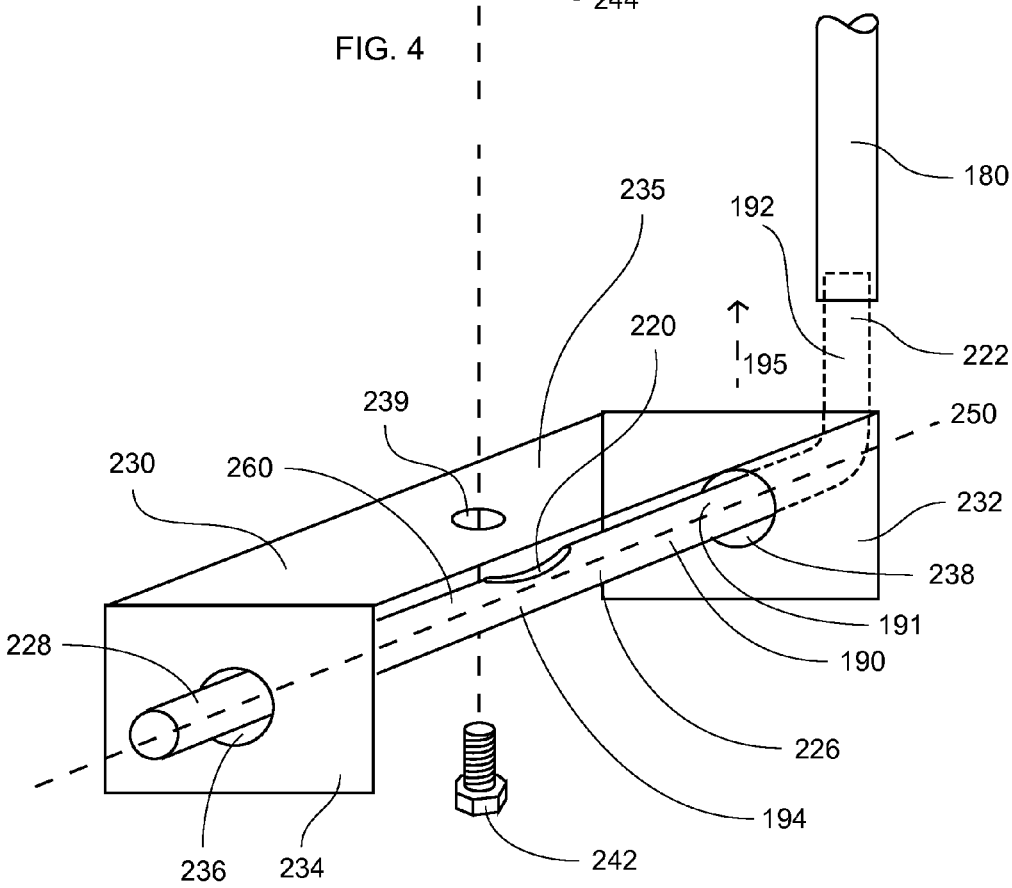
FIG. 5 is a detail view of an intake tube and bracket portion of the floating fluid inlet according to the preferred embodiment.

Referring now to FIG. 1, depicted therein is prior art beverage supply system 10, wherein prior art beverage supply system 10 comprises inlet port 20, outlet port 30, relief valve 40, pickup tube 50 having pickup tube opening 70 and soda keg 80 having bottom 60. Inlet port 20 is in fluid communication with a gas pressure source (not shown), such as, for exemplary purposes only, a carbon dioxide cylinder, thereby permitting pressurization of soda keg 80. Pickup tube 50 is secured to outlet port 30, wherein pickup tube 50 is utilized to remove beverage B from soda keg 80.

In use, prior art beverage supply system 10 is pressurized via the gas pressure source, thereby causing beverage B to enter pickup tube opening 70 and pass through pickup tube 50, to subsequently exit soda keg 80 via outlet port 30, wherein outlet port 30 is in fluid communication with a tap (not shown) or other means of dispensing beverage B. Due to the positioning of pickup tube opening 70 proximate bottom 60 of soda keg 80, sediment 90 lying on bottom 60 is extracted and carried with beverage B to be ultimately, undesirably, dispensed with a serving of beverage B.

Referring now to FIGS. 2-5, the present invention in a preferred embodiment is floating fluid inlet liquid supply system 100, wherein floating fluid inlet liquid supply system 100 preferably comprises soda keg 110 and floating fluid inlet 105, wherein soda keg 110 is, for exemplary purposes only, a standard container for dispensing soda beverages at a soda fountain. Soda keg 110 preferably comprises bottom 120, inlet port 140, outlet port 160, keg fill port cover 155 and relief valve 150, wherein relief valve 150 is preferably disposed in keg fill port cover 155, and wherein outlet port 160 preferably comprises outlet port extension 170, and wherein inlet port 140 preferably comprises inlet port extension 142. It will be recognized by those skilled in the art that relief valve 150 could be disposed elsewhere on soda keg 110 so long as it provides the ability to relieve pressure within soda keg 110 when activated.

Floating fluid inlet 105 preferably comprises flexible tube 180, pickup tube 190, retainer 200, retaining plug 210, bracket 230 and float 240, wherein flexible tube 180 preferably comprises first extremity 182 and second extremity 184, and wherein pickup tube 190 preferably comprises first end 222, bend 224, horizontal section 226, second end 228, long axis 250 and sidewall 260. Sidewall 260 preferably comprises aperture 220 and bracket 230, wherein bracket 230 comprises first leg 232, second leg 234 and flat section 235, and wherein first leg 232 preferably comprises first opening 238, and wherein second leg 234 preferably comprises second opening 236, and wherein flat section 235 preferably comprises throughhole 239 (best shown in FIG. 5). Aperture 220 could be any shape, but is oval according to the preferred embodiment. Float 240 preferably comprises top 248 and bottom 246, wherein bottom 246 preferably comprises threaded insert 244 (best shown in FIG. 4).

Float 240 is preferably removably secured to bracket 230 via bolt 242, wherein bolt 242 preferably passes through bracket 230 via throughhole 239, and wherein bolt 242 preferably threadedly engages threaded insert 244. It will be recognized by those skilled in the art that other cooperative fasteners than bolt 242 and threaded insert 244 could be utilized to secure float 240 to bracket 230.

Pickup tube 190 is preferably removably secured to bracket 230 by passing second end 228 through retainer 200, wherein retainer 200 preferably frictionally engages pickup tube 190. Second end 228 of pickup tube 190 is preferably subsequently passed through first opening 238 and then through second opening 236. Pickup tube 190 is preferably removably secured within bracket 230 via retaining plug 210, wherein retaining plug 210 preferably seals second end 228 of pickup tube 190, and wherein pickup tube 190 is preferably free to rotate about long axis 250 within bracket 230. First extremity 182 of tube 180 is preferably removably secured to outlet port extension 170 and second extremity 184 of flexible tube 180 is preferably removably secured to first end 222 of pickup tube 190, wherein pickup tube 190 is preferably bent at approximately a ninety degree angle forming first portion 192 and second portion 194. Second portion 194 preferably comprises long axis 250, wherein first portion 192 and aperture 220 are preferably disposed on the same side of pickup tube 190. Accordingly, first portion 192 extends away from side 191 of second portion 194 in first direction 195, wherein aperture 220 is disposed on side 191, and wherein aperture 220 faces first direction 195.

In use, beverage B is preferably introduced into soda keg 110. Floating fluid inlet 105 is preferably disposed within soda keg 110, wherein pickup tube 190 is preferably secured to second extremity 184 of flexible tube 180, and first extremity 182 of flexible tube 180 is preferably secured to outlet port extension 170 as described hereinbefore. Subsequently, soda keg 110 is preferably sealed via keg opening cover 155. Beverage B is selectively allowed to stand for a period of time to permit sediment 130 to separate from beverage B and accumulate on bottom 120. It will be recognized by those skilled in the art that floating fluid inlet 105 may be introduced after beverage B is allowed to settle without departing from the spirit of the preferred embodiment.

When soda keg 110 is full of beverage B, soda keg 110 is pressurized by gas via inlet port 140 and float 240 preferably carries floating fluid inlet 105 to the top of beverage B liquid level, wherein flexible tube 180 preferably hangs downward thereby causing pickup tube 190 to rotate about long axis 250, and wherein aperture 220 preferably points in a vertically-downward fashion and is disposed below liquid level to prevent pickup of gas A from above beverage B. As beverage B is drawn from soda keg 110, float 240 preferably carries floating fluid inlet 105 downward, thereby preferably straightening flexible tube 180 and preferably causing pickup tube 190 to rotate about long axis 250, wherein aperture 220 points vertically-upward away from sediment 130 when floating fluid inlet 105 is disposed proximate bottom 120.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A floating fluid inlet comprising:

a float;

a pickup tube comprising a first end, a second end, a first portion including said first end and a second portion including a long axis, said second end and a sidewall, wherein said sidewall comprises an aperture therein wherein when said floating fluid inlet is disposed at the top of a soda keg, said aperture points vertically downward, and when said floating fluid inlet is disposed at the bottom of said soda keg, said aperture points vertically upward; and a bracket securing said pickup tube to said float, wherein said bracket comprises openings dimensioned to receive said pickup tube, and wherein said openings are dimensioned to permit said pickup tube to rotate within said openings about said long axis.

2. The floating fluid inlet of claim 1, wherein said bracket comprises two legs, and wherein said openings comprise two openings, and wherein one of said two openings is disposed in one of said two legs of said bracket, and the other of said two openings is disposed in the other of said two legs, and wherein said two legs are substantially parallel.

3. The floating fluid inlet of claim 2, further comprising a retainer and a retaining plug.

4. The floating fluid inlet of claim 3, wherein said two legs comprise a first leg and a second leg, and wherein said retainer is removably disposed on said pickup tube outboard of said first leg, and wherein said retaining plug is removably disposed outboard of said second leg on said pickup tube, and wherein said retaining plug seals said second end of said pickup tube.

5. The floating fluid inlet of claim 4, wherein said floating fluid inlet further comprises a flexible tube, wherein said flexible tube comprises a first extremity and a second extremity, and wherein said first extremity is removably secured to an outlet port extension of a soda keg, and wherein said second extremity is removably secured to said first end of said pickup tube.

6. The floating fluid inlet of claim 5, wherein said pickup tube is bent into an approximate ninety degree angle forming said first portion and said second portion.

7. The floating fluid inlet of claim 6, wherein said first portion extends away from a side of said second portion in a first direction, and wherein said aperture is disposed on said side, and wherein said aperture faces said first direction.

8. The floating fluid inlet of claim 7, wherein said float is secured to said bracket via a removable cooperative fastener.

9. A fluid dispensing system comprising:

a soda keg; and the floating fluid inlet of claim 1.

10. A method of drawing liquid from a container, said method comprising the steps of:

obtaining a floating fluid inlet comprising a float, a pickup tube having a first end, a second end, a sidewall and an aperture in said sidewall, a bracket securing said pickup tube to said float, wherein said bracket comprises openings dimensioned to receive said pickup tube, and wherein said openings are dimensioned to permit said pickup tube to rotate about its long axis;

installing said floating fluid inlet in said container;

filling said container with a beverage; and drawing said beverage from said container, wherein said pickup tube rotates the aperture from a downwardly disposed position to an upwardly disposed position as said beverage is withdrawn.

11. The method of claim 10, further comprising the steps of:

removing said floating fluid inlet from said container; and disassembling said float from said bracket.

12. The method of claim 11, wherein said floating fluid inlet further comprises a retainer and a retaining plug, said method further comprising the step of:

removing said retaining plug and said retainer.

13. The method of claim 12, said method further comprising the step of:

cleaning said float, said pickup tube, said bracket, said retainer and said retaining plug.

14. The method of claim 13, further comprising the steps of:

reassembling said float to said bracket;

reassembling said pickup tube within said bracket wherein said pickup tube is secured via said retainer and said retaining plug; and reinstalling said floating fluid inlet in said container.

15. A system for drawing liquid from a vessel, said system comprising:

a floating fluid inlet comprising a float, a pickup tube having a long axis, a sidewall and an aperture in said sidewall, and a bracket securing said pickup tube to said float, wherein said bracket comprises openings dimensioned to receive said pickup tube, and wherein said openings are dimensioned to permit said pickup tube to rotate about said long axis, and wherein said aperture rotates from a downward disposition to an upward disposition as the liquid is drawn from the vessel.

16. The system of claim 15, wherein said aperture comprises an oval.

17. The system of claim 15, wherein said pickup tube comprises two portions having a ninety degree angle therebetween, wherein said first portion is disposed on the same side of said pickup tube as said aperture.

* * * * *